US005449420A

United States Patent [19]

Okada et al.

[11] Patent Number: 5,449,420

[45] Date of Patent: Sep. 12, 1995

[54] HIGH STRENGTH STEEL MEMBER WITH A LOW YIELD RATIO

[75] Inventors: Yasutaka Okada, Nara; Yasuhide Fujioka, Wakayama, both of Japan

[73] Assignee: Sumitomo Metal Industries, Ltd., Osaka, Japan

[21] Appl. No.: 286,217

[22] Filed: Aug. 5, 1994

Related U.S. Application Data

[63] Continuation of Ser. No. 87,293, Jul. 8, 1993, Pat. No. 5,374,322.

[30] Foreign Application Priority Data

Jul. 9, 1992 [JP] Japan ..... 4-182480
Jun. 17, 1993 [JP] Japan ..... 5-146169

[51] Int. Cl.[6] ..... C22C 38/18

[52] U.S. Cl. ..... 148/333; 148/334; 148/335; 148/909

[58] Field of Search ..... 420/104, 105, 109, 110, 420/112; 148/333, 334, 335, 909

[56] References Cited

PUBLICATIONS

Busby et al., Tensile and Impact Properties of Low--Carbon Martensites, Transactions, ASM, vol. 47, Preprint No. 9, Nov. 1954, pp. 91 to 922 Key to Steel, 10 ed. 1974, Germany.

*Primary Examiner*—Deborah Yee
*Attorney, Agent, or Firm*—Burns, Doane, Swecker & Mathis

[57] ABSTRACT

A high tensile strength, low yield ratio steel member has a steel composition consisting essentially of, by weight:

C: 0.15–0.40%, Si: 0.10–0.70%, Mn: 1.0–2.7%,
Cr: 1.0–3.5%, sol.Al: 0.01–0.05%,
P: not larger than 0.025%, S: not larger than 0.015%,
Mo: 0–1.0% Ni: 0–2.5%,
V: 0–0.10%, Ti: 0–0.10%, Nb: 0–0.10%,
B: 0–0.0050%.

Fe and incidental impurities: balance the below-described bainite index (%) of the steel composition being 0–50%, the steel being comprised of a single phase of martensite or a martensite and bainite duplex structure containing 50% or less of bainite.

Bainite Index (%) = −209

$$C+43Si-48Mn-58Cr-0.416R+317$$

wherein R is a cooling rate (°C./min).

18 Claims, 1 Drawing Sheet

HIGH STRENGTH STEEL MEMBER WITH A LOW YIELD RATIO

This application is a continuation of application Ser. No. 08/087,293, filed Jul. 8, 1993, now U.S. Pat. No. 5,374,322.

This invention relates to a high strength steel member with a low yield ratio and a method of producing the same at relatively low costs. The steel member of this invention is superior to conventional ones in respect to cold workability such as tube-formability, press-formability, bending ability, and drawability. Instead of quenching following finish forming, normalizing can be applied to the steel member of this invention so as to achieve high strength and improved toughness, and therefore quenching distortion does not occur. Thus, according to this invention, a high strength and improved toughness can be achieved with normalizing or tempering at a much lower temperature than usual.

Steel members of this invention can be used as reinforcing materials for vehicles such as automobiles, e.g., door panel reinforcing members, reinforcing frames, and shock-absorbing materials, and structural materials for earthquake-resistant high-rise buildings, e.g., steel plates, steel shapes, and steel rods. These materials are suitable for absorbing stresses imparted thereto by deformation. Since these materials can absorb much impact energy, they are called impact resistant steel materials.

Conventional impact resistant steels for use in the above-described applications include the following steel materials. 1) Japanese Laid-Open Unexamined Specification No. 58-197218/1983 discloses a stabilizing tubular member which is manufactured by water quenching followed by tempering of a plain carbon steel. However, distortion after quenching is inevitable, and it is rather difficult to remove the distortion. 2) Japanese Patent Publication No.4-4389/1992 discloses a bicycle frame of high strength which is manufactured by air hardening and tempering. However, this type of steel has a fine acicular hardened structure comprising a ferrite and cementite, and its yield point is 800–1100 N/mm$^2$ (81.6–112.2 kgf/mm$^2$, which is not enough to satisfy the strength requirements in the above-mentioned applications. 3) U.S. Pat. No.4,210,467 discloses a process for manufacturing an automobile door panel reinforcing pipe comprising the steps of shaping the pipe with predetermined outer and inner diameters, heating the shaped pipe to an $Ac_3$ point or higher temperature, hot forming the pipe (pipe-end shaping) during cooling, and air cooling to provide the tube with a predetermined level of strength, toughness and ductility. The resulting properties include a T.S. of 110–140 kgf/mm$^2$, a Y.S. of 80–110 kgf/mm$^2$, an elongation of 13% or more, and a deformation load of 240 kgf/mm$^2$ or more. However, since it sometimes comprises a ferritic phase or more than 50 vol. % of a bainite phase, steel materials which exhibit a T.S. of 120 kgf/mm$^2$ or larger and a yield ratio of 75% or less cannot be obtained. These properties are thought to be necessary for use in the above-mentioned applications.

SUMMARY OF THE INVENTION

As an impact resistant steel member for use in automobiles, steel tube, hot-rolled steel plate, and cold-rolled steel plate having a tensile strength of up to 100 kgf/mm$^2$ have been used. In order to further improve the resistance to impact of the steel member and to further increase its strength so as to decrease the weight of the member, it is necessary to achieve a T.S. of 120 kgf/mm$^2$ or more and a yield ratio (yield strength/tensile strength) of 75% or less. However, such levels could not be obtained in the past.

On the other hand, in order to improve the resistance to earthquakes for structures such as buildings and especially high-rise buildings, high strength steel materials having a yield ratio as low as 75% or less are desired. However, such low yield ratio steel materials could not be obtained in the past.

A ferrite+pearlite steel has a low yield ratio of 75% or less, but the strength of this steel is 80 kgf/mm$^2$ at best, which is far below a target value of 120 kgf/mm$^2$ or higher. A quenched and tempered steel can exhibit this high level of strength, but its yield ratio is at least 80% and sometimes over 90%. A steel of this type usually exhibits poor toughness and is not suitable for use in a shock resistant structural member.

Since safety in car accidents as well as weight reductions of car bodies are highly desired in the automobile industry, and since the use of an earthquake and shock-resistant steel member is also highly desired in high-rise buildings, it is desirable to use a high tensile strength steel material having a high degree of work hardening but a low yield ratio (Y.S./T.S.). However, when a high tensile strength steel member is employed to achieve weight savings in an automobile body, the resistance to shock is degraded for a steel material having a yield ratio of 75% or higher.

Thus, a target value for the T.S. is 120 kgf/mm$^2$ or higher and that for the yield ratio is 75% or lower at present. Furthermore, taking into consideration the use of such steel materials in cold districts, it is required that the vTrs of such shock-resistant steel materials be −40° C. or lower.

A primary object of the present invention is to provide a steel member with a high tensile strength and a low yield ratio and a method of producing the same, the tensile strength of the steel being 120 kgf/mm$^2$ or higher, the yield ratio being 75% or less, and the vTrs being −40° C. or lower, the steel being usable as a shock-resistant steel member.

As mentioned above, a steel with a high tensile strength and toughness exhibits a remarkable ability to absorb mechanical shocks. In view of its economy, such a material can be produced by quenching-tempering of carbon steels (hardness of martensite is utilized), or controlled cooling of a hot-rolled plate of low C-high Mn steel (formation of bainite is utilized). However, weldability is also required, since welding is employed to assemble or fix the shock resistant steel members to an assembly or to produce welded pipes when the steel member is used in the form of a hollow pipe. However, the weldability of conventional shock resistant steel materials is poor. With carbon steels, for example, the HAZ is softened markedly, and the deposited metal area is hardened. Cracking occurs when the area is bent. On the other hand, in the case of low C-high Mn steels, the deposit metal area is free from hardening, but softening and cracking of the HAZ are inevitable.

Thus, a secondary object of the present invention is to provide a steel member with a high tensile strength and a low yield ratio and a method of producing the same with the deposited metal area being free from hardening and the HAZ being free from softening even when welding is carried out during assembly, pipe manufacture, or installation in an assembly, the steel member being usable as a shock-resistant steel member.

The shock resistant steel members of the present invention are manufactured in the form of pipe, plate, bar, or the like. However, usually, it is rather difficult to carry out sizing as the tensile strength increases. In addition, cracking easily occurs when a steel member having an increased tensile strength is deformed forcibly.

Furthermore, it has been thought that cold working of steel materials exhibiting a T.S. of 120 kgf/mm$^2$ or higher is substantially impossible because cracking and buckling of the steel member, damage to dies, and a marked increase in deformation resistance are inevitable.

A third object of the present invention, therefore, is to provide a steel member with a high tensile strength and a low yield ratio and a method of producing the same, it being easy to carry out straightening of the member, which is manufactured with precise dimensions and does not require any additional steps of straightening, or which can be further cold worked, and which can be used as a shock-resistant steel member.

An overall object of the present invention is to provide a steel member of a high tensile strength and low yield ratio and a method of producing the same in large quantities in a less expensive manner, the weld zone of the steel member being free from fluctuations in hardness and also free from cracking during bending as well as a distortion during quenching, the steel member being capable of use as automobile door panel reinforcing members and high strength structural members for high-rise buildings.

The inventors of the present invention made the following discoveries.

(1) Strength and Toughness

It has been thought that it is advantageous to employ an as-quenched material in order to provide a steel member with a high strength at low costs. For this purpose it has been known to utilize water-quenching followed by tempering at a temperature as low as 200° C. or less. However, water-quenching results in relatively large distortions which must be recovered at a later stage. Furthermore, when the strength of the steel member is high, cracking and buckling, for example, occur with a degradation in accuracy in size during recovery of the distortions, making the recovery rather difficult from a practical viewpoint. Thus, from a practical viewpoint it is desirable that quenching be carried out by air cooling.

According to the findings of the present inventors, it is possible to carry out quenching by air cooling when a steel composition is adjusted to a suitable one, particularly when the bainite index is restricted to 0–50%, and a steel member having a high strength and toughness with a low yield ratio can be obtained.

(2) Dimensional Accuracy

In order to ensure the dimensional accuracy which is required for reinforcing members, especially in order to remove the bending which occurs during forming, it is necessary to employ a sizer. However, when the strength of a steel member increases, its elastic limit also increases, making the straightening extremely difficult. Cracking is sometimes inevitable when the straightening is carried out at room temperature.

If the quenching is carried out without using water quenching, i.e., if air-cooling quenching is carried out successfully, it is possible to produce steel members having a high dimensional accuracy as quenched.

Furthermore, it is also found that sizing at room temperature is possible when the steel composition is so adjusted that it exhibits a value of vTrs of −40° C. and a yield ratio of 75% or less.

Although oil quenching is also possible, it adds to processing costs and is not suitable for mass production. An additional step to remove oil from the hardened steel member is also necessary. Thus, oil quenching is not desirable from a practical viewpoint.

(3) Hardness of Weld Zone

It is necessary to suppress an increase or decrease in hardness of a weld metal zone and a HAZ during assembly, pipe manufacture, or installation in an assembly by welding. Namely, it is desirable that the hardness of a weld zone be substantially the same as hardness of the base material. The hardness of these zones is strongly influenced by the steel composition of a base material. The steel composition can be determined by using two indices, i.e., a hardening index by which the hardness of a weld metal zone can be determined, and a softening index by which the hardness of the HAZ can be determined.

In summary, the present invention is a high tensile strength, low yield ratio steel member having a steel composition which consists essentially of, by weight:

C: 0.15–0.40%, Si: 0.10–0.70%, Mn: 1.0–2.7%,

Cr: 1.0–3.5%, sol.Al: 0.01–0.05%,

P: not larger than 0.025%, S: not larger than 0.015%,

Fe and incidental impurities: balance the below-described bainite index (%) of the steel composition being 0–50%, the steel being comprised of a single phase of martensite or a martensite and bainite duplex structure containing 50% or less of bainite.

Bainite Index $$(\%) = -209C + 43Si - 48Mn - 58Cr - 0.416R + 317$$

wherein R is a cooling rate (°C./min).

The steel composition may further contain at least one of the elements of the following groups:

(i) one or more of Mo: 0.05–1.0% and Ni: 0.2–2.5%, and (ii) one or more of V: 0.02–0.10%, Ti: 0.02–0.10%, Nb: 0.02–0.10%, and B: 0.0005–0.0050%.

In this case, the bainite index may be described as follows.

Bainite Index $$(\%) = -209C + 43Si - 48Mn - 58Cr - 13Ni - 6\text{-}3Mo - 0.416R + 317$$

In a preferred embodiment of the present invention, the softening index of the HAZ and the hardening index of the weld metal zone may be defined as follows in order to improve weldability.

$$\text{Softening Index: } 301 - 53Mn - 66Cr \leqq 100 \quad (1)$$

$$\text{Hardening Index: } 580 - 394C + 80Si - 114Mn - 139Cr \leqq 100 \quad (2)$$

In the case where at least Mo or V is included, the softening index can be modified as follows.

$$\text{Softening Index: } 301 - 53Mn - 66Cr - 80Mo - 93V \leqq 100 \quad (1')$$

In the case where at least Mo or Ni is included, the hardening index above can be modified as follows.

Hardening Index:

$$580-394C+80Si-114Mn-139Cr-120Mo-2-5Ni \leqq 100 \quad (2')$$

In another aspect, the present invention is a method of producing a high strength, low yield ratio steel member comprising the steps of carrying out final hot working of a steel having the above-described steel composition with a finishing temperature of 800°–1000° C., carrying out additional working, if desired, reheating the resulting steel member at a temperature of 850°–1050° C. for 0.5 minute –2 hours, and cooling the steel member at a cooling rate R defined by the following equation:

$$642-502C+103Si-115Mn-139Cr \leqq R \leqq 762-502-C+103Si-115Mn-139Cr \quad (3)$$

In the case where at least Mo or Ni is included, Equation (3) is modified as follows.

$$642-502C+103Si-115Mn-139Cr-31Ni-15-1Mo \leqq R \leqq 762-502C+10-3Si-115Mn-139Cr-31Ni-151Mo \quad (3')$$

In general, the finishing temperature of the hot working and the re-heating temperature can be described as $Ar_3$ to ($Ar_3$+200° C.) and $Ac_3$ to ($Ac_3$+200° C.), respectively.

Optionally, tempering at a temperature of 300° C. or less may be carried out after cooling at the rate R.

When the above-mentioned additional working is cold rolling, it is desirable that the following softening heat treatment be applied prior to the cold rolling.

$$175 \leqq T\{[\log(t)+20)]/100\} \leqq 200 \quad (4)$$

wherein T: Softening Heat Treatment Temperature (K)

t: Treatment Time (hour)

Thus, according to the present invention, since dimensional accuracy can be improved markedly because quench hardening can be achieved by air cooling and because straightening can be done under cold conditions, it is possible to produce a long steel tube, and the manufacturing costs thereof can be reduced markedly compared with those of short-length tubes.

Steel members produced in accordance with the method of the present invention include various types of steel members, such as steel plates, steel pipes, steel bars, and steel rods. They can be used as a shock-absorbing member for use in automobiles. They can also be used in buildings as structural members having a great ability to absorb the great shocks provided by earthquakes.

DESCRIPTION OF THE PREFERRED EMBODIMENTS

Figure 1:
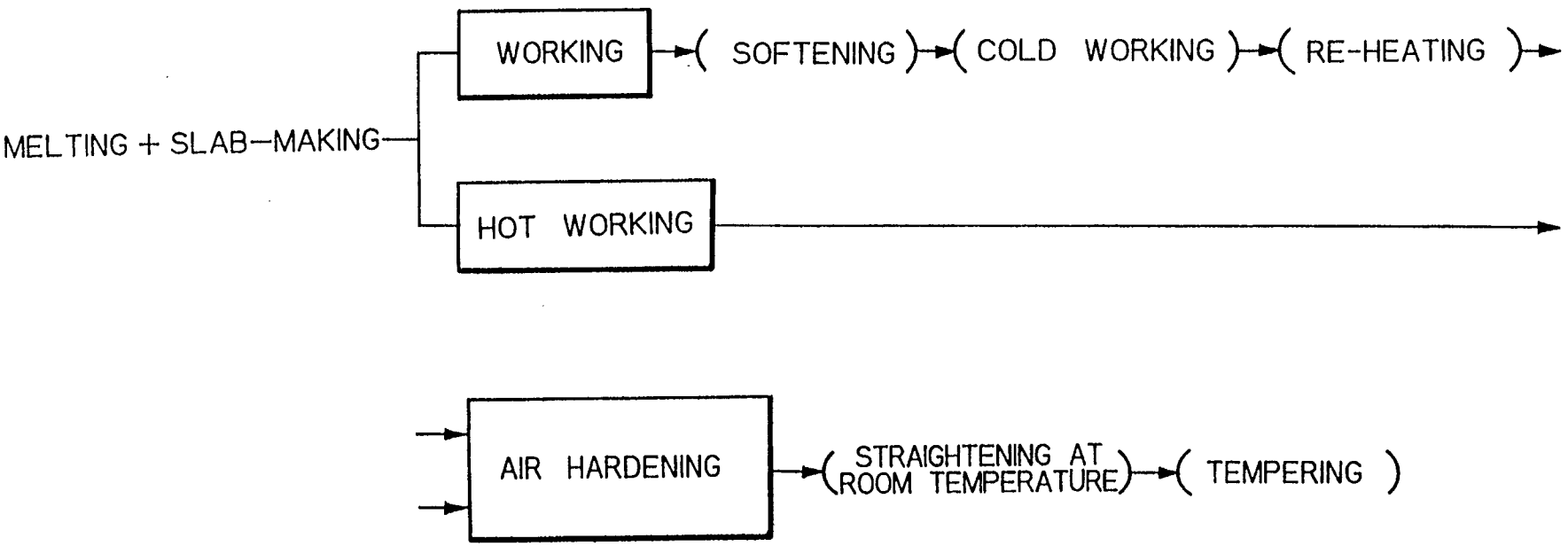
FIG. 1 is a flow diagram of a method of manufacturing the shock resistant steel member of the present invention.

The reasons for restricting the steel composition and manufacturing conditions of the present invention as in the above will be explained in detail.

CHEMICAL COMPOSITION

Carbon

Carbon (C) is necessary for obtaining a consistently high level of strength. When the carbon content is below 0.15%, it is impossible to obtain a strength of 120 kgf/mm$^2$ by means of heat treatment. A yield ratio of 0.75 or less cannot be achieved, either. On the other hand, when the carbon content is over 0.40%, the strength of an as-quenched steel material is so high that a sufficient level of toughness (vTrs$\leqq$−40° C.) cannot be attained.

In order to achieve a TS of 140 kgf/mm$^2$ or higher and a yield ratio of 0.70 or less, it is desirable that the carbon content be restricted to 0.19% or higher. Furthermore, in order to achieve a sufficient level of toughness to prevent brittle fracture even in cold districts, a value of vTrs of −60° C. or lower must be attained. For this purpose, it is desirable that the carbon content be restricted to 0.3% or less. Most preferably, the carbon content is 0.20–0.25%.

Silicon (Si)

Silicon is added as a deoxidizer. When the content of Si is less than 0.1%, deoxidization does not occur thoroughly, and a necessary level of toughness cannot be attained. On the other hand, when the Si content is over 0.7%, there is a tendency for weld defects to easily occur while manufacturing weld pipes. A preferable content of Si is 0.2–0.4%.

Manganese (Mn)

Manganese is necessary for improving hardenability of steel. When the content of Mn is less than 1.0%, such an effect cannot be attained thoroughly and the yield ratio is higher than 0.75. On the other hand, when the Mn content is over 2.7%, cracking or inclusion of slag during solidification of billets easily occur, resulting in a degradation in toughness after heat treatment. Preferably, the Mn content is 1.5–2.2%.

Chromium (Cr)

Chromium is effective for improving hardenability as well as toughness. The incorporation of Cr is also effective to suppress excess softening during tempering. Like Mn, Cr is essential to the present invention in which a long pipe is quenched by cooling at a cooling rate corresponding to that of air cooling with distortions caused by quenching being greatly suppressed compared with those caused by water quenching. However, Cr in an amount of more than 3.5% adds to material costs and is unable to prevent occurrence of weld defects. On the other hand, when the Cr content is less than 1.0%, improvements in hardenability, toughness, and resistance to softening are not thorough. A preferred Cr content is 1.5–2.5%.

sol. Al

Aluminum is added as a deoxidizer. When the content of sol. Al is less than 0.01%, deoxidization does not occur sufficiently to ensure satisfactory toughness. However, when the content of sol. Al is over 0.05%, weld defects easily occur during manufacture of welded pipe.

Phosphorous (P), Sulfur (S)

P and S are typical impurities in steel. The presence of P and S is restricted to not larger than 0.025% and not larger than 0.015%, respectively, in order to prevent the formation of quenching cracks and to avoid a degradation in toughness after heat treatment. Especially, when it is required that a toughness of vTrs of −40° C. or lower be ensured at a T.S. of 150 kgf/mm$^2$ or more, it is preferable to restrict the amounts of P and S to not larger than 0.015% and not larger than 0.005%, respectively.

Mo, V, Ni, Ti, Nb, B

These are optional elements. In order to improve hardenability, at least one of Mo and Ni, and/or at least one of V, Ti, Nb, and B is added, if necessary, to the steel of the present invention. Effects of these optional elements will be explained in detail.

Molybdenum (Mo)

When Mo is added, Mo in an amount of not less than 0.05% is effective to promote hardenability, toughness, and the resistance to softening during tempering. Like Mn, Mo is essential to the present invention in which a long pipe is quenched by cooling at a cooling rate corresponding to that of air cooling with distortions caused by quenching being greatly suppressed compared with those caused by water quenching. However, Mo in an amount of more than 1.0% adds to material costs and is unable to prevent occurrence of weld defects, and when the Mo content is less than 0.05%, improvements in hardenability, toughness, resistance to softening, and yield ratio are not thorough.

Nickel (Ni)

Ni is effective to improve hardenability and toughness when Ni is added in an amount of 0.2% or more. Ni is still effective when it is added over its upper limit, i.e., 2.5%, but the incorporation of such a large amount of Ni adds to material costs and is not desirable from the viewpoint of economy.

Vanadium (V)

Vanadium, when added in an amount of 0.02–0.10%, is effective to refine crystal grains and also to improve the resistance to softening during tempering. However, V in an amount of more than 0.10% adds to material costs.

Titanium (Ti), Niobium (Nb)

These are effective to improve hardenability when added in an amount of 0.02–0.10% each. They are also effective to prevent coarsening of crystal grains during quenching and to improve the toughness of a weld zone. However, when the content of each of them is over their respective upper limit of 0.10%, toughness is degraded.

Boron (B)

Boron is effective to improve hardenability. When necessary, B in an amount of 0.0005–0.0050% is added. Boron in an amount of less than 0.0005% has substantially no effect, and boron in an amount of more than 0.0050% deteriorates toughness.

Bainite Index

When the bainite index is over 50%, the strength decreases, the yield ratio increases, and the toughness decreases, and it is impossible to achieve a tensile strength of 120 kgf/mm$^2$ or more, a yield ratio of 75% or lower, and vTrs of −40° C. or lower. In contrast, when the bainite index is zero, it means that the resulting steel is comprised of a single martensite phase.

Softening Index of the HAZ

Even when Mo and/or Ni is added, a degradation in toughness of a weld zone is inevitable for a steel member with a softening index outside the range of the present invention.

Hardening Index of the Weld Metal Zone

Even when Mo and/or Ni is added, a degradation in toughness of a weld zone is inevitable for a steel member with a hardening index outside the range of the present invention.

Manufacturing Steps

FIG. 1 is a flow diagram of a method of manufacturing the shock resistant steel member of the present invention. The manufacturing method comprises the steps of working, reheating, and air quenching in that order (Case-1), or it comprises the steps of hot working and air cooling (Case-2). The steps indicated within boxes in FIG. 1 are essential steps to the present invention. The other steps, i.e., the steps within parentheses are optional.

According to the present invention, as shown in Case-1, working which is usually hot working is followed by cold working. Before cold working, a softening treatment is carried out under the conditions already mentioned. Examples of this cold working include cold bending to shape a steel strip into a tubular form in the manufacture of welded pipe, and cold forging a steel pipe into an automobile door panel reinforcing member, e.g., flattening both ends of the pipe. Following the cold working, a metallurgical structure is adjusted by heating the resulting steel member at a temperature of $Ac_3$ to ($Ac_3$+200)° C., usually 850°–1050° C. for 0.5 minute −2 hours. After heating, air quenching is carried out. As mentioned before, according to the present invention, since quenching is carried out by natural cooling, i.e., cooling at a rate corresponding to air cooling, dimensional defects, such as bends, and distortions are few.

Tempering may be applied after quenching.

In Case-2, hot working is finished at a temperature of $Ar_3$ to ($Ar_3$+200), usually 800°–1000° C., and air quenching is carried out thereafter. If necessary, the before-mentioned straightening of dimensional bends at room temperature and tempering may be applied. Since automobile door panels are finally painted at a temperature of about 300° C. or below, tempering may be carried out by utilizing this heat of painting.

Examples of seamless pipe forming methods that can be used in the present invention include the Mannnessman method and hot extrusion.

Examples of welded pipe include ERW steel pipe (electric resistance welded steel pipe), forge welded pipe, TIG welded pipe, and submerged arc welded pipe.

In the manufacture of seamless steel pipe, thick steel plate, steel shape, steel bar, and steel wire by hot rolling, the hot rolling is finished at a temperature of 800°-1000° C. When the finishing temperature is below 800° C., formation of ferrite is inevitable, resulting in a decrease in strength after cooling. On the other hand, when the finishing temperature is over 1000° C., crystal grains are coarsened, resulting in a degradation in toughness and an easy occurrence of quenching cracks.

On the other hand, the re-heating, when applied, includes heating at 850°-1050° C. for 0.5 minutes to 2 hours followed by cooling at a rate corresponding to that of air cooling. Before quenching it is necessary to provide an austenite phase. For this purpose heating at a temperature of 850° C. or higher is necessary. When this heating temperature is over 1050° C., coarsening of crystal grains with a degradation in toughness is inevitable. A heating time of shorter than 0.5 minute is unable to heat the steel pipe uniformly, and a fluctuation in mechanical properties of the steel pipe is inevitable. On the other hand, when the heating time is over 2 hours, if heating is performed to a temperature near 1050° C., coarsening of crystal grains inevitable, resulting in a degradation in toughness and easy occurrence of quenching cracks.

Cooling Rate

Restrictions on the cooling rate are introduced so as to make quenching achievable by air cooling without resulting in bends. The restrictions on the cooling rate are defined by the before-mentioned Equation (3).

According to the cooling conditions of the present invention, a martensite+bainite complex structure predominantly comprising martensite with a satisfactory level of strength and toughness and a yield ratio of 0.75 or less can be obtained. When the cooling rate is outside the range of the present invention, the desired effects mentioned above cannot be obtained.

Bainite Index

A metallurgical structure achieved by the present invention can be determined by a chemical steel composition and a cooling rate, and the cooling rate is determined primarily by the thickness of a steel plate member to be handled by the present invention. Thus, the bainite factor is formulated in view of these factors.

It is apparent that the bainite index can be determined by the chemical composition and cooling rate. This index substantially corresponds to the proportion of a bainite phase, i.e., an index of 0% means that a single phase of martensite remains and an index of 100% means that a single phase of bainite remains. When the index is smaller than 0%, this means that the structure is comprised of 100% of martensite, and that the cooling rate R can be relatively high so that the yield ratio is increased over the target value. Quenching cracks and delayed cracks are inevitable. On the other hand, when the index value is over 50%, the strength of the steel member is smaller than the target value, and the yield ratio is over 0.75 with a decrease in toughness.

When the bainite index is below zero, it means that the cooling rate is higher than the critical cooling rate to achieve 100% martensite. Such an excessively high cooling rate causes an easy occurrence of large bends and cracking during quenching, and delayed cracking easily occurs during straightening. Furthermore, the yield ratio inevitably increases.

In typical procedures of the method of the present invention, quenching, i.e., cooling is carried out using air as a cooling medium. If necessary, a mist, shower, forced air, or combinations thereof may be used to carry out quenching. When a cooling medium is mainly comprised of water, i.e., when water quenching is employed, quenching cracks and bends easily occur. However, when such defects can be recovered by straightening, water quenching is not excluded from the present invention as long as the bainite index or the cooling rate R is within the range of the present invention.

Tempering

In a preferred embodiment of the present invention, tempering at a temperature of 300° C. or less may be carried out so as to remove residual stresses and to further improve toughness. When the tempering temperature is higher than 300° C., it is impossible to ensure a sufficient level of strength and toughness, and the yield ratio also increases.

Straightening

According to the present invention, mechanical straightening can be performed with a straightener and the like. Usually, many times of straightening are necessary to perform straightening of a high strength steel member at a temperature of lower than 100° C., and cracking during straightening is inevitable. However, the steel member of the present invention is totally free from cracking during straightening because the steel member exhibits an improved toughness. In addition, since the yield ratio is low, deformation easily occurs, making the straightening possible at a relatively low temperature of from room temperature to 300° C.

The present invention will be described in detail in conjunction with working examples, which are presented merely for illustrative purposes.

Example 1

Steels having the steel compositions shown in Table 1 were melted. After being subjected to slabbing or continuous casting, the resulting slabs were hot rolled or additionally re-heated and air quenched under the conditions shown in Tables 2 and 3. Some of the specimens were also subjected to straightening at room temperature and tempering. Mechanical properties were determined for the resulting steel specimens. The results are also shown in Tables 2 and 3.

Steel members of Series A were steel pipes manufactured through the steps of melting in an electric furnace, slabbing, and Mannesmann pipe manufacturing processes. Steel members A3 and A7 were hot rolled steel plates produced through the steps of steel making in a converter, continuous casting, and hot rolling.

Steel members of Series B were steel pipes having an outer diameter of 25 mm, which were manufactured through the steps of steel making in a converter, hot rolling (hot strip 1.5–4.5 mm thick), and pipe forming with ERW processes.

The steel pipes were reheated in a batch-type heating furnace or an induction heating furnace and cooled at indicated cooling rates. For some of them, straightening and/or tempering were performed. Steel pipes A1 and A2 were those which were cooled after hot rolling.

Correction in size was carried out with a rotary straightener. Usually, the straightening is carried out at a temperature of room temperature to 300° C. before tempering, but straightening may be performed after finishing tempering and cooling to room temperature or straightening may be performed following the tempering. In either manner, substantially the same effect can be obtained.

Bends in the steel members of the present invention are indicated in Tables 2 and 3 as a bend (mm) per meter of length. Correction of bending was usually carried at one time. In the Tables, the long pipes were 5–10 meters long and the short ones were cut into 1 meter lengths.

As is apparent from the results shown in Tables 2 and 3, according to the present invention, a strength of 120 kgf/mm$^2$ or higher, a value of vTrs of −40° C. or lower, and a yield ratio of 0.75 or smaller could be achieved. In the case of short pipes, a bend of 1 mm or less could be achieved after heat treatment, and for the long pipes it was possible to suppress the bend within 1 mm by applying sizing even for the long pipes which were quenched at a rather high cooling rate (including water quenching).

Conventional pipes indicated as B9 and B11 in Table 3 suffered from quenching cracks and weld defects, respectively.

TABLE 1

| 555 Steel Type | Chemical Composition (wt %) C | Si | Mn | P | S | sol.Al | Cr | Mo | V | Ni | Ti | Nb | B | Remarks |
|---|---|---|---|---|---|---|---|---|---|---|---|---|---|---|
| A1 | 0.28 | 0.25 | 2.66 | 0.023 | 0.008 | 0.03 | 1.08 | — | — | — | — | — | 0.0015 | Present |
| B1 | 0.38 | 0.38 | 1.09 | 0.014 | 0.012 | 0.02 | 2.38 | — | — | — | — | — | — | Invention |
| A2 | 0.19 | 0.11 | 1.52 | 0.018 | 0.013 | 0.01 | 2.33 | — | — | — | — | — | — | |
| B2 | 0.24 | 0.68 | 2.07 | 0.003 | 0.006 | 0.02 | 2.53 | — | — | — | 0.03 | — | 0.0038 | |
| A3 | 0.24 | 0.18 | 2.55 | 0.021 | 0.011 | 0.05 | 1.77 | — | — | — | — | 0.03 | — | |
| B3 | 0.29 | 0.34 | 2.23 | 0.016 | 0.004 | 0.03 | 2.05 | — | — | — | 0.08 | — | — | |
| A4 | 0.33 | 0.16 | 1.53 | 0.011 | 0.008 | 0.01 | 1.89 | — | — | — | — | — | 0.0007 | |
| B4 | 0.24 | 0.41 | 2.34 | 0.017 | 0.015 | 0.02 | 1.18 | 0.05 | — | — | — | 0.07 | — | |
| A5 | 0.20 | 0.53 | 1.74 | 0.023 | 0.012 | 0.05 | 1.23 | 0.99 | — | — | — | — | — | |
| B5 | 0.26 | 0.34 | 1.58 | 0.019 | 0.014 | 0.02 | 1.54 | 0.54 | 0.04 | — | — | — | 0.0009 | |
| A6 | 0.16 | 0.33 | 1.86 | 0.006 | 0.005 | 0.02 | 2.44 | — | 0.10 | — | — | — | — | |
| B6 | 0.34 | 0.26 | 1.35 | 0.012 | 0.014 | 0.04 | 1.55 | — | — | 0.75 | — | — | — | |
| A7 | 0.25 | 0.22 | 1.10 | 0.005 | 0.015 | 0.03 | 2.75 | — | — | 2.14 | — | — | — | |
| B7 | 0.24 | 0.24 | 1.56 | 0.009 | 0.014 | 0.03 | 1.57 | 0.26 | — | — | — | 0.03 | — | |
| A8 | 0.27 | 0.28 | 1.84 | 0.016 | 0.012 | 0.03 | 1.61 | — | 0.04 | — | — | — | 0.0015 | |
| B8 | 0.24 | 0.26 | 1.92 | 0.015 | 0.011 | 0.03 | 1.95 | — | — | — | 0.03 | 0.05 | 0.0012 | |
| A9 | 0.38 | 0.61 | 1.62 | 0.016 | 0.011 | 0.03 | 1.54 | — | — | — | — | — | — | |
| B9 | 0.17 | 0.25 | 1.64 | 0.014 | 0.09 | 0.02 | 1.55 | — | — | — | — | — | — | |
| A10 | 0.12 | 0.33 | 0.84 | 0.013 | 0.013 | 0.01 | 1.01 | — | — | — | — | — | — | Conventional |
| B10 | 0.48 | 0.64 | 2.97 | 0.019 | 0.019 | 0.02 | 1.02 | — | — | — | — | — | — | |
| A11 | 0.17 | 0.08 | 1.22 | 0.023 | 0.015 | 0.008 | 1.02 | — | — | — | — | — | — | |
| B11 | 0.19 | 0.94 | 1.34 | 0.021 | 0.013 | 0.02 | 1.01 | — | — | 0.11 | — | — | — | |
| A12 | 0.26 | 0.21 | 1.03 | 0.003 | 0.012 | 0.01 | 1.01 | 1.76 | — | — | 0.13 | — | — | |
| B12 | 0.35 | 0.27 | 1.09 | 0.021 | 0.014 | 0.06 | 1.27 | — | 0.16 | — | — | — | — | |
| A13 | 0.33 | 0.23 | 1.86 | 0.016 | 0.005 | 0.03 | 0.68 | — | — | — | — | 0.15 | — | |
| B13 | 0.23 | 0.26 | 1.29 | 0.011 | 0.011 | 0.02 | 3.29 | — | — | — | — | — | 0.0062 | |

Note - A: Seamless Steel Pipe, Steel Plate, B: Welded Steel Pipe

TABLE 2

| Steel Type | Pipe/Plate Short or Long | Thickness (mm) | Hot Rolling Finishing Temp. (°C.) | Reheating Temp. (°C.) | Reheating Time (min) | Cooling Conditions Cooling Rate (R) (°C./min) | R (Calculated) Upper limit | R (Calculated) Lower limit | Straightening Yes or No | Straightening Temp. (°C.) | Tempering Temp. (°C.) | Tempering Time (min) |
|---|---|---|---|---|---|---|---|---|---|---|---|---|
| A1 | Long | 2.5 | Batch | 920 | 15 | 100 | 70 | 190 | Yes | RT | — | |
| A1 | " | 2.5 | 1045 | — | | 100 | 70 | 190 | " | RT | 250 | 10 |
| A1 | " | 2.5 | Batch | 130 | 100 | 70 | 190 | " | 150 | 380 | 20 | |
| B1 | " | 3.0 | IH | 980 | 0.5 | 85 | 31 | 151 | " | RT | — | |
| B1 | " | 3.0 | Batch | 1100 | 5 | 85 | 31 | 151 | No | — | — | |
| B1 | " | 3.0 | IH | 880 | 0.2 | 85 | 31 | 151 | Yes | RT | 200 | 150 |
| A2 | " | 3.5 | 950 | — | | 70 | 55 | 175 | " | RT | — | |
| B2 | " | 3.5 | Batch | 900 | 15 | 70 | 0 | 118 | " | 150 | 200 | 15 |
| A3 | Steel Plate | 3.0 | Batch | 980 | 1.5 | 80 | 0 | 117 | " | RT | — | |
| B3 | Long | 3.5 | IH | 920 | 20 | 70 | 0 | 108 | " | RT | 200 | 10 |
| A4 | " | 3.5 | Batch | 930 | 15 | 70 | 53 | 173 | " | RT | — | |
| A4 | " | 3.5 | Batch | 930 | 15 | 200 | 53 | 173 | " | 100 | 50 | 5 |
| A4 | " | 7.0 | Batch | 930 | 15 | 20 | 53 | 173 | " | 250 | 150 | 5 |
| B4 | " | 2.0 | Batch | 900 | 15 | 125 | 122 | 242 | No | — | 150 | 25 |
| A5 | " | 2.0 | Batch | 950 | 25 | 125 | 72 | 192 | Yes | 150 | 150 | 10 |
| B5 | " | 3.5 | Batch | 980 | 10 | 100 | 66 | 186 | " | 150 | 150 | 5 |
| A6 | " | 2.5 | IH | 970 | 3 | 100 | 43 | 163 | " | RT | 50 | 30 |
| B6 | " | 2.2 | Batch | 880 | 20 | 115 | 102 | 222 | " | RT | — | |
| A7 | Steel Plate | 6.0 | Batch | 900 | 10 | 45 | 0 | 82 | " | RT | 200 | 20 |
| B7 | Long | 1.5 | Batch | 910 | 15 | 170 | 105 | 225 | " | RT | 130 | 20 |
| A8 | " | 2.5 | IH | 1000 | 2 | 125 | 96 | 216 | " | RT | 200 | 15 |
| B8 | " | 3.5 | Batch | 940 | 15 | 70 | 54 | 174 | " | RT | - | |

| Steel Type | Bainite Index (%) | Bend (mm) | T.S. (kgf/mm$^2$) | Y.S. (kgf/mm$^2$) | Y.R. (YS/TS) | vTrs (°C.) | Remarks |
|---|---|---|---|---|---|---|---|
| A1 | 37 | 0.9 | 177 | 113 | 0.64 | −68 | Invention |
| A1 | 37 | 0.6 | 161 | 124 | 0.77 | 49 | Comparative |
| A1 | 37 | 0.7 | 92 | 75 | 0.82 | -26 | |

TABLE 2-continued

| | | | | | | | |
|---|---|---|---|---|---|---|---|
| B1 | 28 | 0.2 | 176 | 117 | 0.67 | −65 | Invention |
| B1 | 28 | 1.4 | 164 | 118 | 0.72 | 36 | Comparative |
| B1 | 28 | 0.5 | 114 | 98 | 0.86 | −16 | |
| A2 | 45 | 0.6 | 163 | 103 | 0.63 | −64 | Present |
| B2 | 21 | 0.4 | 146 | 98 | 0.67 | −70 | Invention |
| A3 | 16 | 0.9 | 147 | 101 | 0.69 | −63 | |
| B3 | 16 | 0.7 | 151 | 107 | 0.71 | −57 | |
| A4 | 43 | 0.5 | 186 | 119 | 64 | -48 | |
| A4 | −11 | — | 205 | 160 | 0.78 | 15 | Comparative |
| A4 | 64 | 0.6 | 84 | 62 | 0.74 | −13 | |
| B4 | 49 | 0.9 | 145 | 97 | 0.67 | −46 | Present |
| A5 | 29 | 0.5 | 132 | 86 | 0.65 | −68 | Invention |
| B5 | 36 | 0.4 | 154 | 97 | 0.63 | −53 | |
| A6 | 25 | 0.2 | 141 | 95 | 0.67 | −64 | |
| B6 | 45 | 0.7 | 183 | 113 | 0.62 | −45 | |
| A7 | 15 | 0.2 | 136 | 96 | 0.70 | −96 | |
| B7 | 24 | 0.4 | 153 | 107 | 0.70 | −74 | |
| A8 | 39 | 0.7 | 140 | 90 | 0.64 | −56 | |
| B8 | 44 | 0.8 | 185 | 115 | 0.62 | −59 | |

Note- : A-Seemless Steel Pipe, Steel Plate, B-Welded Steel Pipe
: Ferrite is included
IH: High Frequency Heating

TABLE 3

| | Pipe/Plate | | Hot Rolling | Reheating | | Cooling Conditions | | | Straightening | | Tempering | |
|---|---|---|---|---|---|---|---|---|---|---|---|---|
| | Short | Thick- | Finishing | | | Cooling | R (Calculated) | | Yes | | | |
| Steel Type | or Long | ness (mm) | Temp. (°C.) | Temp. (°C.) | Time (min) | Rate (R) (°C./min) | Upper limit | Lower limit | or No | Temp. (°C.) | Temp. (°C.) | Time (min) |
| A10 | Short | 2.5 | IH | 950 | 15 | 160 | 378 | 498 | No | — | 250 | 15 |
| B10 | " | 1.5 | IH | 870 | 30 | 265 | 0 | 100 | " | RT | 50 | 10 |
| A11 | " | 3.0 | IH | 930 | 20 | 125 | 282 | 402 | " | — | 250 | 20 |
| B11 | Long | 2.5 | Batch | 930 | 20 | 80 | 341 | 461 | Yes | 400 | 250 | 20 |
| A12 | Short | 2.5 | IH | 930 | 20 | 70 | 6 | 126 | No | — | 250 | 20 |
| B12 | Long | 2.5 | Batch | 930 | 20 | 80 | 191 | 311 | Yes | 500 | 175 | 15 |
| A13 | " | 2.5 | Batch | 930 | 20 | 80 | 191 | 311 | " | 400 | 550 | 20 |
| B13 | " | 2.5 | Batch | 930 | 20 | 100 | 0 | 65 | " | 350 | 250 | 20 |

| Steel Type | Bainite Index (%) | Bend (mm) | T.S. (kgf/mm²) | Y.S. (kgf/mm²) | Y.R. (YS/TS) | vTrs (°C.) | Remarks |
|---|---|---|---|---|---|---|---|
| A10 | 141 | 1.5 | 112 | 100 | 0.89 | −76 | Conventional |
| B10 | −68 | — | 210 | 179 | 0.85 | 45 | |
| A11 | 115 | 1.2 | 118 | 98 | 0.83 | 13 | |
| B11 | 160 | 0.4 | 101 | 87 | 0.86 | 73 | |
| A12 | 24 | 1.6 | 176 | 127 | 0.72 | 25 | |
| B12 | 96 | 0.7 | 153 | 121 | 0.79 | 35 | |
| A13 | 96 | 0.3 | 72 | 63 | 0.87 | −14 | |
| B13 | −14 | 0.6 | 146 | 128 | 0.88 | 46 | |

Note-A: Seamless Steel Pipe, Steel Plate, B: Welded Steel Pipe
IH: High Frequency Heating
: Shower Cooling, : Ferrite is included

Example 2

In this example, Example 1 was repeated except that the steel members were reheated and cooled after hot working. The resulting steel members were subjected to a $CO_2$ fillet welding at 110 A×16V at a rate of 30 cm/min, and the weld zone was inspected. In this example, straightening was not performed.

Bending properties of the weld zone were determined by inspecting whether or not cracking occurred when a heavy weight was dropped from a height of 5 meter onto the steel pipes and steel plates which were supported by a span of 1 meter to bend the pipes and plates by 135 degrees. There was no cracking in the base material.

The weld zone (40 mm long) was inspected for cracking on the side surfaces of the pipe and the under surface of the plate. It was found that there was no cracking for the steel members in which the hardening index was not larger than 100 and the softening index was not larger than 100.

The test results are summarized in Tables 4 and 5. The types of the steel compositions are the same as those indicated in Table 1.

TABLE 4

| | Pipe/Plate | | Reheating | | Cooling Conditions | | | | | | |
|---|---|---|---|---|---|---|---|---|---|---|---|
| | Short | Thick- | | | Cooling | R (Calculated) | | Bainite | Temper- | | |
| Steel Type | or Long | ness (mm) | Temp. (°C.) | Time (min) | Rate (R) (°C./min) | Upper limit | Lower limit | Index (%) | ing (°C.) | T.S. (kgf/mm²) | Y.S. (kgf/mm²) |
| A1 | Long | 2.5 | 925 | 15 | 100 | 70 | 190 | 37 | 150 | 157 | 100 |
| B1 | " | 3.0 | 980 | 0.5 | 85 | 31 | 151 | 28 | — | 181 | 121 |
| A2 | " | 3.5 | 920 | 30 | 80 | 55 | 175 | 41 | — | 151 | 95 |
| B2 | " | 3.5 | 900 | 15 | 80 | 0 | 118 | 17 | — | 157 | 105 |

TABLE 4-continued

| | | | | | | | | | | | |
|---|---|---|---|---|---|---|---|---|---|---|---|
| A3 | Steel Plate | 3.0 | 980 | 30 | 80 | 0 | 117 | 16 | — | 163 | 109 |
| B3 | Long | 4.5 | 920 | 20 | 60 | 0 | 108 | 20 | — | 157 | 113 |
| A4 | " | 2.0 | 930 | 15 | 100 | 53 | 173 | 30 | — | 182 | 118 |
| B4 | " | 2.0 | 900 | 15 | 125 | 122 | 242 | 49 | — | 147 | 98 |
| A5 | " | 2.0 | 950 | 25 | 125 | 72 | 192 | 29 | 50 | 134 | 87 |
| B5 | " | 3.5 | 980 | 10 | 100 | 66 | 186 | 37 | 50 | 155 | 98 |
| A6 | " | 2.5 | 970 | 3 | 100 | 43 | 163 | 25 | — | 144 | 97 |
| B6 | " | 2.2 | 880 | 120 | 140 | 102 | 222 | 34 | — | 177 | 109 |
| A7 | Steel Plate | 6.0 | 900 | 10 | 45 | 0 | 82 | 15 | — | 138 | 97 |
| B7 | Long | 1.5 | 910 | 15 | 170 | 105 | 225 | 24 | — | 157 | 110 |
| A8 | " | 2.5 | 1000 | 2 | 125 | 96 | 216 | 39 | — | 142 | 91 |
| B8 | " | 3.5 | 940 | 15 | 100 | 54 | 174 | 31 | — | 180 | 112 |
| A9 | " | 2.5 | 950 | 2 | 170 | 114 | 234 | 26 | — | 174 | 122 |
| B9 | " | 2.5 | 950 | 2 | 180 | 178 | 298 | 49 | — | 138 | 99 |

| | | | Weldability | | | |
|---|---|---|---|---|---|---|
| Steel Type | Y.R. (YS/TS) | vTrs (°C.) | Hardening Index | Softening Index | Bending | Remarks |
| A1 | 0.64 | −68 | 35 | 89 | ○ | Present Invention |
| B1 | 0.67 | −55 | 3 | 86 | ○ | |
| A2 | 0.63 | −64 | 13 | 67 | ○ | |
| B2 | 0.67 | −72 | −50 | 24 | ○ | |
| A3 | 0.67 | −73 | −40 | 49 | ○ | |
| B3 | 0.72 | −46 | −48 | 48 | ○ | |
| A4 | 0.65 | −44 | 25 | 95 | ○ | |
| B4 | 0.67 | −46 | 25 | 95 | ○ | |
| A5 | 0.65 | −68 | 53 | 48 | ○ | |
| B5 | 0.63 | −53 | 43 | 59 | ○ | |
| A6 | 0.67 | −64 | −8 | 32 | ○ | |
| B6 | 0.62 | −45 | 79 | 127 | x | |
| A7 | 0.70 | −96 | −64 | 61 | ○ | |
| B7 | 0.70 | −74 | 74 | 94 | ○ | |
| A8 | 0.64 | −56 | 59 | 94 | ○ | |
| B8 | 0.62 | −59 | 15 | 71 | ○ | |
| A9 | 0.70 | −41 | 80 | 113 | x | |
| B9 | 0.72 | −76 | 131 | 111 | x | |

Note-A: Seamless Steel Pipe, Steel Plate, B: Welded Steel Pipe
Hardening Index = 580 − 394C + 80Si − 114Mn − 139C4 − 120Mo − 25Ni ≦ 100
Softening Index = 301 − 53Mn − 66Cr − 80Mo − 93V ≦ 100

TABLE 5

| | Pipe/Plate | | | | Cooling Conditions | | | | | | |
|---|---|---|---|---|---|---|---|---|---|---|---|
| | | | Reheating | | | R (Calculated) | | | | | |
| Steel Type | Short or Long | Thickness (mm) | Temp. (°C.) | Time (min) | Cooling Rate (R) (°C./min) | Upper limit | Lower limit | Bainite Index (%) | Tempering (°C.) | T.S. (kgf/mm²) | Y.S. (kgf/mm²) |
| A10 | Short | 2.5 | 950 | 15 | 200 | 378 | 498 | 124 | — | 113 | 101 |
| B10 | " | 3.5 | 870 | 30 | 300 | 0 | 100 | −84 | — | 207 | 176 |
| A11 | " | 3.0 | 930 | 20 | 55 | 282 | 402 | 144 | 200 | 107 | 91 |
| B11 | Long | 2.5 | 930 | 20 | 70 | 341 | 461 | 162 | — | 166 | 143 |
| A12 | Short | 2.5 | 930 | 20 | 70 | 6 | 126 | 23 | — | 193 | 139 |
| B12 | Long | 2.5 | 930 | 20 | 100 | 191 | 311 | 87 | — | 117 | 92 |
| A13 | " | 2.5 | 930 | 20 | 100 | 191 | 311 | 87 | — | 103 | 90 |
| B13 | " | 2.5 | 930 | 20 | 250 | 0 | 65 | −78 | 250 | 159 | 140 |
| A1 | Long | 2.5 | 830 | 150 | 100 | 70 | 190 | 37 | — | 108 | 85 |
| B1 | " | 3.0 | 1030 | 0.3 | 85 | 31 | 151 | 28 | — | 189 | 132 |
| A2 | " | 3.5 | 900 | 15 | 30 | 55 | 175 | 61 | — | 116 | 100 |
| B2 | " | 3.5 | 900 | 15 | 150 | 0 | 118 | −14 | — | 164 | 128 |
| A3 | Steel Plate | 3.0 | 880 | 0.1 | 80 | 0 | 117 | 16 | — | 137 | 112 |
| B3 | Long | 4.5 | 1050 | 30 | 60 | 0 | 108 | 19 | — | 167 | 124 |
| A4 | " | 2.0 | 950 | 60 | 100 | 53 | 173 | 30 | 350 | 111 | 93 |
| B4 | " | 2.0 | 950 | 60 | 125 | 122 | 242 | 49 | 350 | 106 | 91 |

| | | | Weldability | | | |
|---|---|---|---|---|---|---|
| Steel Type | Y.R. (YS/TS) | vTrs (°C.) | Hardening Index | Softening Index | Bending | Remarks |
| A10 | 0.89 | −76 | 323 | 190 | x | Conventional |
| B10 | 0.85 | 42 | −41 | 76 | x (High S) | |
| A11 | 0.85 | 13 | 238 | 169 | x | |
| B11 | 0.86 | −29 | 281 | 163 | x | |
| A12 | 0.72 | 25 | 23 | 39 | x (High S) | |
| B12 | 0.79 | 35 | 162 | 145 | x | |
| A13 | 0.87 | −14 | 161 | 158 | x | |
| B13 | 0.88 | 46 | −96 | 15 | x | |
| A1 | 0.79 | 42 | 35 | 89 | x (Brittle) | Comparative |

TABLE 5-continued

| | | | | | |
|---|---|---|---|---|---|
| B1 | 0.70 | 8 | 3 | 86 | ○ |
| A2 | 0.86 | −28 | 13 | 67 | ○ |
| B2 | 0.78 | −22 | −50 | 24 | ○ |
| A3 | 0.82 | 15 | −40 | 49 | ○ |
| B3 | 0.74 | 33 | −48 | 48 | ○ |
| A4 | 0.84 | −46 | 25 | 95 | ○ |
| B4 | 0.86 | −40 | 80 | 99 | ○ |

Note-A: Seamless Steel Pipe, Steel Plate, B: Welded Steel Pipe
: Ferrite is included
Hardening Index = 580 − 394C + 80Si − 114Mn − 139Cr − 120Mo − 25Ni ≦ 100
Softening Index = 301 − 53Mn − 66Cr − 80Mo − 93V ≦ 100

Example 3

In this example, Example 1 was repeated except that the steel members were subjected to softening annealing followed by cold working after hot working. The resulting steel members were subjected to a tensile test.

The results are summarized in Table 6 and 7. The types of the steel compositions are the same as those indicated in Table 1. Although not indicated in Table 7, quenching cracks occurred for the conventional steel B10 and weld defects occurred for the conventional steel B12.

TABLE 6

| | Pipe/Plate | | | | | | | | Cooling Conditions | | | Straightening | |
|---|---|---|---|---|---|---|---|---|---|---|---|---|---|
| | | | Softening Annealing | | | | Heating | | Cooling | R (Calculated) | | | |
| Steel Type | Short or Long | Thickness (mm) | Temp. (°C.) | Time (h) | Parameter | T.S. (kgf/mm²) | Temp. (°C.) | Time (min) | Rate (R) (°C./min) | Upper limit | Lower limit | Yes or No | Temp. (°C.) |
| A1 | Long | 2.5 | 580 | 5 | 177 | 79 | 920 | 15 | 100 | 70 | 190 | Yes | RT |
| A1 | " | 2.5 | 550 | 10 | 173 | 87 | 1070 | 0.3 | 100 | 70 | 190 | " | RT |
| A1 | " | 2.5 | 750 | 5 | 212 | 69 | 820 | 150 | 100 | 70 | 190 | " | 350 |
| B1 | " | 3.0 | 580 | 5 | 177 | 82 | 980 | 0.5 | 85 | 31 | 151 | " | RT |
| B1 | " | 3.0 | 550 | 10 | 173 | 89 | 1100 | 5 | 85 | 31 | 151 | No | — |
| B1 | " | 3.0 | 720 | 3 | 203 | 65 | 880 | 0.2 | 85 | 31 | 151 | Yes | 200 |
| A2 | " | 3.5 | 720 | 1 | 199 | 60 | 920 | 30 | 70 | 55 | 175 | " | RT |
| A2 | " | 3.5 | 600 | 1 | 175 | 82 | 900 | 6 | 25 | 55 | 175 | No | — |
| B2 | " | 3.5 | 720 | 1 | 199 | 65 | 900 | 15 | 95 | 0 | 118 | Yes | 150 |
| B2 | " | 3.5 | 640 | 1 | 185 | 72 | 920 | 30 | 200 | 0 | 118 | No | — |
| A3 | Steel Plate | 3.0 | 600 | 10 | 183 | 71 | 980 | 30 | 80 | 0 | 117 | Yes | RT |
| A3 | " | 3.0 | 750 | 24 | 219 | 82 | 1020 | 60 | 25 | 0 | 117 | No | — |
| B3 | Long | 4.5 | 700 | 2 | 198 | 64 | 920 | 20 | 60 | 0 | 108 | Yes | RT |
| B3 | " | 4.5 | 750 | 12 | 216 | 78 | 1030 | 5 | 250 | 0 | 108 | No | — |
| A4 | " | 2.0 | 650 | 5 | 191 | 63 | 930 | 15 | 70 | 53 | 173 | Yes | RT |
| B4 | " | 2.0 | 650 | 5 | 191 | 61 | 900 | 15 | 125 | 122 | 242 | No | — |
| A5 | " | 2.0 | 650 | 5 | 191 | 58 | 950 | 25 | 125 | 72 | 192 | Yes | 150 |
| B5 | " | 3.5 | 650 | 5 | 191 | 60 | 980 | 10 | 100 | 66 | 186 | " | 150 |
| A6 | " | 2.5 | 650 | 5 | 191 | 63 | 970 | 3 | 100 | 43 | 163 | " | RT |
| B6 | " | 2.2 | 650 | 5 | 191 | 61 | 880 | 120 | 115 | 102 | 222 | " | RT |
| A7 | Steel Plate | 6.0 | 650 | 5 | 191 | 63 | 900 | 10 | 45 | 0 | 82 | " | RT |
| B7 | Long | 1.5 | 650 | 5 | 191 | 59 | 910 | 15 | 170 | 105 | 225 | " | RT |
| A8 | " | 2.5 | 650 | 5 | 191 | 61 | 1000 | 2 | 125 | 96 | 216 | " | RT |
| B8 | " | 3.5 | 650 | 5 | 191 | 63 | 940 | 15 | 70 | 54 | 174 | " | RT |

| Steel Type | Bainite Index (%) | Tempering (°C.) | T.S. (kgf/mm²) | Y.S. (kgf/mm²) | Y.R. (TY/TS) | vTrs (°C.) | Remarks |
|---|---|---|---|---|---|---|---|
| A1 | 37 | 150 | 154 | 98 | 0.64 | −68 | Invention |
| A1 | 37 | — | 161 | 124 | 0.77 | 49 | Comparative |
| A1 | 37 | 200 | 111 | 91 | 0.82 | −16 | |
| B1 | 28 | — | 178 | 119 | 0.67 | −55 | Invention |
| B1 | 28 | — | 164 | 118 | 0.72 | 36 | Comparative |
| B1 | 28 | 300 | 114 | 98 | 0.86 | −16 | |
| A2 | 45 | — | 154 | 97 | 0.63 | −64 | Invention |
| A2 | 64 | — | 112 | 83 | 0.74 | 24 | Comparative |
| B2 | 10 | — | 159 | 107 | 0.67 | −72 | Invention |
| B2 | −33 | 320 | 118 | 101 | 0.86 | −26 | Comparative |
| A3 | 16 | — | 164 | 110 | 0.67 | −73 | Present Invention |
| A3 | 39 | — | 127 | 97 | 0.76 | 18 | Comparative |
| B3 | 20 | — | 157 | 113 | 0.72 | −46 | Invention |
| B3 | −59 | — | 155 | 130 | 0.84 | 45 | Comparative |
| A4 | 43 | — | 183 | 119 | 0.65 | −44 | Present |
| B4 | 49 | — | 148 | 99 | 0.67 | −46 | Invention |
| A5 | 29 | 50 | 133 | 86 | 0.65 | −68 | |
| B5 | 37 | 50 | 157 | 99 | 0.63 | −53 | |
| A6 | 25 | — | 143 | 96 | 0.67 | −64 | |
| B6 | 45 | — | 178 | 110 | 0.62 | −45 | |
| A7 | 15 | — | 137 | 96 | 0.70 | −96 | |
| B7 | 24 | — | 155 | 109 | 0.70 | −74 | |
| A8 | 39 | — | 141 | 90 | 0.64 | −56 | |

TABLE 6-continued

| | | | | | | | | | | | | | |
|---|---|---|---|---|---|---|---|---|---|---|---|---|---|
| | | | | | | | B8 | 44 | — | 181 | 113 | 0.62 | −59 |

Note-A: Seamless Steel Pipe, Steel Plate, B: Welded Steel Pipe
: Ferrite is included

TABLE 7

| | Pipe/Plate | | | | | | | | Cooling Conditions (R) | | | Straightening | |
|---|---|---|---|---|---|---|---|---|---|---|---|---|---|
| | Short | Thick- | Softening Annealing | | | | Heating | | Cooling | R (Calculated) | | Yes | |
| Steel Type | or Long | ness (mm) | Temp. (°C.) | Time (h) | Para-meter | T.S. (kgf/mm²) | Temp. (°C.) | Time (min) | Rate (R) (°C./min) | Upper limit | Lower limit | or No | Temp. (°C.) |
| A10 | Short | 2.5 | 600 | 1 | 175 | 71 | 950 | 15 | 200 | 378 | 498 | No | — |
| B10 | " | 1.5 | 600 | 1 | 175 | 90 | 870 | 30 | 300 | 0 | 100 | " | RT |
| A11 | " | 3.0 | 600 | 1 | 175 | 74 | 930 | 20 | 55 | 282 | 402 | " | — |
| B11 | Long | 2.5 | 600 | 1 | 175 | 76 | 930 | 20 | 70 | 341 | 461 | Yes | 400 |
| A12 | Short | 2.5 | 600 | 1 | 175 | 76 | 930 | 20 | 70 | 6 | 126 | No | — |
| B12 | Long | 2.5 | 600 | 1 | 175 | 79 | 930 | 20 | 100 | 191 | 311 | " | — |
| A13 | " | 2.5 | 600 | 1 | 175 | 79 | 930 | 20 | 100 | 191 | 311 | Yes | 400 |
| B13 | " | 2.5 | 600 | 1 | 175 | 87 | 930 | 20 | 250 | 0 | 65 | No | — |

| Steel Type | Bainite Index (%) | Temper-ing (°C.) | T.S. (kgf/mm²) | Y.S. (kgf/mm²) | Y.R. (TY/TS) | vTrs (°C.) | Remarks |
|---|---|---|---|---|---|---|---|
| A10 | 124 | — | 115 | 102 | 0.89 | −76 | Comparative |
| B10 | −82 | — | 208 | 177 | 0.85 | 42 | |
| A11 | 144 | 200 | 109 | 93 | 0.85 | 13 | |
| B11 | 164 | — | 76 | 65 | 0.86 | −29 | |
| A12 | 24 | 250 | 176 | 127 | 0.72 | 25 | |
| B12 | 88 | — | 153 | 121 | 0.79 | 35 | |
| A13 | 88 | — | 72 | 63 | 0.87 | −14 | |
| B13 | −77 | 250 | 146 | 128 | 0.88 | 46 | |

Note-A: Seamless Steel Pipe, Steel Plate, B: Welded Steel Pipe
: Ferrite is included

What is claimed:

1. A high tensile strength, low yield ratio steel member having a steel composition which consists essentially of, by weight:

C: 0.15–0.40%, Si: 0.10–0.70%, Mn: 1.0–2.7%,
Cr: 1.0–3.5%, sol. Al: 0.01–0.05%,
P: not larger than 0.025%, S: not larger than 0.015%,
Mo: 0–1.0%., Ni: 0–2.5%,
V: 0–0.10%, Ti: 0–0.10%, Nb: 0–0.10%,
B:0
Fe and incidental impurities: balance the steel having a tensile strength of at least 120 kfg/mn² and a yield ratio of 0.75 or less, the steel being comprised of a martensite and bainite duplex structure containing 50% or less of bainite and having a bainite index defined by:

Bainite Index (%) $= -209C+43Si-48Mn-58Cr-0.416R+317$ wherein R is a cooling rate (°C./min) of greater than 0 and up to 50%.

2. A high tensile strength, low yield ratio steel member as set forth in claim 1 wherein the steel composition contains one or more of Mo: 0.05–1.0% and Ni: 0.2–2.5%, and the bainite index is defined by:

Bainite Index (%) $= -209C+43Si-48Mn-58Cr-13Ni-63Mo-0.416R+317$.

3. A high tensile strength, low yield ratio steel member as set forth in claim 1 wherein the steel composition contains one or more of V: 0.02–0.10%, Ti: 0.02–0.10%, Nb: 0.02–0.10%.

4. A high tensile strength, low yield ratio steel member as set forth in claim 1 wherein the steel composition is adjusted such that the softening index of the HAZ and the hardening index of the weld metal zone are defined as follows:

Softening Index $=301-53Mn-66Cr \leqq 100$

Hardening Index $=580-394C+80Si-114Mn-139Cr \leqq 100$.

5. A high tensile strength, low yield ratio steel member as set forth in claim 4 wherein the steel composition contains at least Mo or V, and the softening index is Softening Index $=301-53Mn-66Cr-80Mo-93V \leqq 100$.

6. A high tensile strength, low yield ratio steel member as set forth in claim 4 wherein the steel composition contains at least Mo or Ni, and the hardening index is Hardening Index $=580-394C+80Si-114Mn-139Cr-120Mo-25Ni \leqq 100$.

7. A high tensile strength, low yield ratio steel member as set forth in claim 1, wherein the yield ratio is less than 0.75.

8. A high tensile strength, low yield ratio steel member as set forth in claim 1, wherein the yield ratio is no greater than 0.70.

9. A high tensile strength, low yield ratio steel member as set forth in claim 1, wherein Mn: $\leqq 2.07\%$.

10. A high tensile strength, low yield ratio steel member as set forth in claim 1, wherein Mn: $\geqq 1.09\%$.

11. A high tensile strength, low yield ratio steel member as set forth in claim 1, wherein Mn:1.5–2.2%.

12. A high tensile strength, low yield ratio steel member as set forth in claim 1, wherein Si:0.2–0.4%.

13. A high tensile strength, low yield ratio steel member as set forth in claim 1, wherein R:45° to 180° C./min.

14. A high tensile strength, low yield ratio steel member as set forth in claim 1, wherein the steel member comprises a welded steel member.

15. A high tensile strength, low yield ratio steel member as set forth in claim 1, wherein the steel member is in a cold worked and heat treated condition.

16. A high tensile strength, flow yield ratio steel member as set forth in claim 1, wherein the steel member has a thickness no greater than about 6 mm.

17. A high tensile strength, low yield ratio steel member as set forth in claim 1, wherein the steel member comprises a seamless pipe.

18. A high tensile strength, low yield ratio steel member as set forth in claim 1, wherein the steel member comprises an electrically resistance welded pipe.

* * * * *